US012127724B2

(12) United States Patent
Hederos et al.

(10) Patent No.: US 12,127,724 B2
(45) Date of Patent: Oct. 29, 2024

(54) VACUUM CLEANER WITH BAG CONTAINER

(71) Applicant: Aktiebolaget Electrolux, Stockholm (SE)

(72) Inventors: Jesper Hederos, Stockholm (SE); Oskar Lindström, Stockholm (SE); Peter Mian, Stockholm (SE); Dawid Dawod, Stockholm (SE)

(73) Assignee: Aktiebolaget Electrolux, Stockholm (SE)

( * ) Notice: Subject to any disclaimer, the term of this patent is extended or adjusted under 35 U.S.C. 154(b) by 715 days.

(21) Appl. No.: 17/296,030

(22) PCT Filed: Nov. 26, 2018

(86) PCT No.: PCT/EP2018/082555
§ 371 (c)(1),
(2) Date: May 21, 2021

(87) PCT Pub. No.: WO2020/108729
PCT Pub. Date: Jun. 4, 2020

(65) Prior Publication Data
US 2022/0007907 A1 Jan. 13, 2022

(51) Int. Cl.
*A47L 9/14* (2006.01)
*A47L 5/28* (2006.01)
*A47L 9/28* (2006.01)

(52) U.S. Cl.
CPC ..... *A47L 9/1472* (2013.01); *A47L 5/28* (2013.01); *A47L 9/1445* (2013.01); *A47L 9/2857* (2013.01)

(58) Field of Classification Search
CPC ..... A47L 9/14; A47L 9/1409; A47L 9/1418; A47L 9/1427; A47L 9/1436;
(Continued)

(56) References Cited

U.S. PATENT DOCUMENTS 5,755,009 A * 5/1998 Stephens ..... A47L 9/1427 55/378
6,948,212 B2 9/2005 Oh et al.
7,181,803 B2 2/2007 Park et al.
7,310,854 B2 12/2007 Nam et al.
(Continued)

FOREIGN PATENT DOCUMENTS

CN 1136269 A 11/1996
CN 2528381 Y 1/2003
(Continued)

OTHER PUBLICATIONS

Korean Request for the Submission of an Opinion for Korean Application No. 10-2021-7015828, dated Apr. 25, 2023, with translation, 19 pages.
(Continued)

*Primary Examiner* — Eric J Rosen
*Assistant Examiner* — John C Merino
(74) *Attorney, Agent, or Firm* — Bradley Arant Boult Cummings LLP

(57) ABSTRACT

A stick vacuum cleaner comprising an elongated shaft part, a housing arranged to be attached to the elongated shaft part, the housing comprising an air inlet, a container arranged to accommodate a removable air-permeable dust bag, a motor fan unit for creating an airflow, and an exhaust air outlet, a nozzle arranged at a first end of the elongated shaft part, the nozzle comprising a nozzle inlet via which debris is transported from a surface to be cleaned by means of the created airflow to the dust container, and a handle arranged at a second end of the elongated shaft part, wherein the container is arranged to be removably attached to the housing.

20 Claims, 8 Drawing Sheets

(58) Field of Classification Search
CPC .... A47L 9/1445; A47L 9/1454; A47L 9/1463; A47L 9/1472; A47L 9/1481; A47L 9/32; A47L 5/225
See application file for complete search history.

(56) References Cited

U.S. PATENT DOCUMENTS

| | | | |
|---|---|---|---|
| 2004/0010885 | A1 | 1/2004 | Hitzelberger et al. |
| 2007/0062000 | A1 | 5/2007 | Murphy et al. |
| 2007/0113528 | A1* | 5/2007 | Knuth ..... A47L 9/1427 15/352 |
| 2008/0040883 | A1 | 2/2008 | Beskow et al. |
| 2014/0237765 | A1 | 8/2014 | Conrad et al. |

FOREIGN PATENT DOCUMENTS

| | | | |
|---|---|---|---|
| CN | 1462603 | A | 12/2003 |
| CN | 1575720 | A | 2/2005 |
| CN | 1608568 | A | 4/2005 |
| CN | 200973680 | Y | 11/2007 |
| CN | 101313831 | A | 12/2008 |
| CN | 101507590 | A | 8/2009 |
| CN | 102028435 | A | 4/2011 |
| CN | 207679385 | U | 8/2018 |
| GB | 2498450 | A | 7/2013 |
| JP | 2016042898 | A | 4/2016 |
| KR | 19990009779 | U | 3/1999 |
| KR | 200323568 | Y1 | 8/2003 |

OTHER PUBLICATIONS

Chinese Office Action for Chinese Application No. 201880099743.5, dated Apr. 20, 2022 with translation, 21 pages.
International Search Report and Written Opinion for International Application No. PCT/EP2018/082555, dated Aug. 23, 2019, 11 pages.

* cited by examiner

VACUUM CLEANER WITH BAG CONTAINER

This application is a U.S. National Phase application of PCT International Application No. PCT/EP2018/082555, filed Nov. 26, 2018, which is incorporated by reference herein.

TECHNICAL FIELD

The invention relates to a stick vacuum cleaner.

BACKGROUND

Stick type vacuum cleaners are well known in prior art. This type of vacuum cleaner generally has an elongated shaft part with a nozzle in one end and a handle in the other end and a housing attached to/integrated with the shaft part. A stick vacuum cleaner is suitable for floor cleaning and may in some cases also be used for above head cleaning, usually with a different nozzle. Further, the housing comprising e.g. a fan and motor, a dust separation system, a dust container, filter(s), batteries and other necessary parts may be attached to the elongated shaft part and may extend substantially in parallel thereto, or in other ways.

Stick vacuum cleaners allow a user to remove dust and debris in a relatively easy and efficient manner and may be operated with a single hand grip.

In some stick type vacuum cleaners the housing is detachable from the elongated shaft part and may be used independently as a handheld vacuum cleaner separate from the elongated shaft part. This may be practical e.g. for vacuuming bread crumbs and similar debris from tables.

A drawback with many stick type vacuum cleaners is that there may be a risk for a user of contacting the dust when emptying the dust container. Depending on the type of separation system utilized in the vacuum cleaner, the handling of the dust differs. When using a dust separation system comprising a dust bag, the user may have to remove the dust bag from the vacuum cleaner and carry the dust bag to a garbage can. During this procedure there is a risk that the user contacts the dust, e.g. dust will leak, or the dust bag is accidentally dropped or damaged.

SUMMARY

An object of the invention is to solve, or at least mitigate this problem and thus to provide a stick vacuum cleaner which enables improvement of the process of emptying the dust container.

This object is attained in an aspect of the invention by a stick vacuum cleaner comprising, an elongated shaft part, a housing arranged to be attached to the elongated shaft part, said housing comprising an air inlet, a container arranged to accommodate a removable air-permeable dust bag, a motor fan unit for creating an airflow, and an exhaust air outlet, a nozzle arranged at a first end of the elongated shaft part, said nozzle comprising a nozzle inlet via which debris is transported from a surface to be cleaned by means of the created airflow to the dust container, and a handle arranged at a second end of the elongated shaft part, wherein the container is arranged to be removably attached to the housing.

Advantageously, with the invention, the user can easily and straightforwardly remove the removable dust container from the housing and simply carry the removable dust container to a garbage can for disposing the dust bag, and thereafter again attach the removable dust container to the housing, after or before a new dust bag has been placed in the container.

In an embodiment, the container further comprises a bracket arranged to accommodate the removable dust bag. Advantageously, the bracket will firmly hold the dust bag in place in the container.

In an embodiment, the container further comprises an aperture arranged to be openable for advantageously facilitating removal of the dust bag.

In an embodiment, the aperture further comprises at least one flange arranged to press against the dust bag upon a user closing the aperture.

In an embodiment, the container further comprises a blocking device being arranged to prevent the aperture from being closed when no dust bag is accommodated in the bracket. Advantageously, this prevents a user from operating the vacuum cleaner if no dust bag is placed in the bracket.

In an embodiment, the container further comprises a push-button being arranged to advantageously snap open the aperture upon a user pressing the button.

In an embodiment, the bracket further comprises at least one spring-loaded member configured to block the aperture from being closed when no dust bag is placed in the bracket, wherein the dust bag is configured to press against the spring-loaded member when placed in the bracket, causing a spring of the spring-loaded member to compress and move the spring-loaded member in a transversal direction towards an interior of the container, thereby allowing the aperture to be closed, while removal of the dust bag causes the spring to expand and move the spring-loaded member in a transversal direction towards an exterior of the container, thereby blocking the aperture from being closed.

In an embodiment, the container further comprises an exhaust air outlet arranged in a bottom section of the container and being configured to mate with a motor fan inlet of the housing.

In an embodiment, the container air inlet is arranged in a top section of the container and being configured to mate with a shaft air outlet.

In an embodiment, the container further comprises a snap-in mechanism configured to removably attach the container to the housing. Hence, the container may swiftly be snapped into—and snapped out of—contact with the housing.

In an embodiment, the container further comprises elongated protruding members arranged on an interior wall of the container. Advantageously, this prevents the dust bag from adhering to the interior walls of the dust container, which may block the air flow passing from the air inlet to the air outlet.

In an embodiment, the container further comprises one or more protruding members arranged at the air outlet of the container for preventing the dust bag from adhering to the air outlet.

In an embodiment, the dust container further comprises a visual indicator configured to indicate to a user a degree of fullness of the dust bag.

In an embodiment, the container further comprises a push-button being arranged to release the container from the housing upon a user pressing the button.

Further embodiments will be described in the following.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

Figure 1:
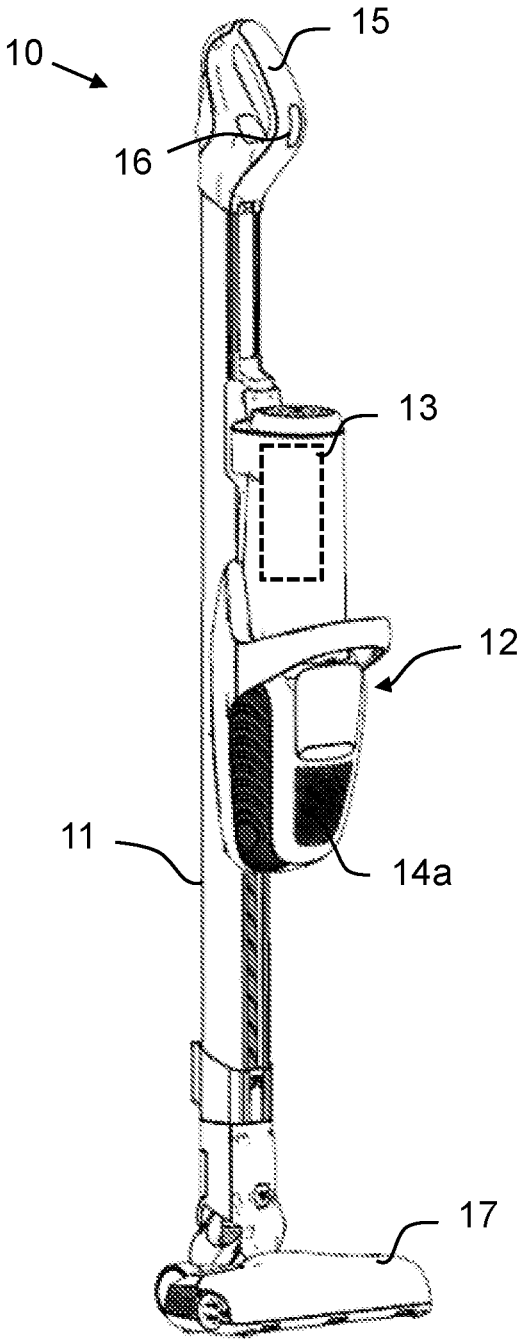
FIG. 1 illustrates a prior art vacuum cleaner in perspective view, in which the invention can be implemented.

FIG. 1 illustrates a prior art vacuum cleaner 10 in perspective view, in which the invention can be implemented. This particular type of vacuum cleaner is known as an upright cleaner or stick cleaner. The vacuum cleaner may be powered by a chargeable battery, an electric cable or a combination of the two.

The vacuum cleaner 10 comprises an elongated shaft part 11 to which a housing 12 is attached. The housing 12 may be detachable or not detachable, e.g. integrated into the shaft part 11. The housing 12 may be made as a hollow body or structure for housing some parts of the vacuum cleaner 10. For instance, the housing 12 typically comprises a motor fan unit (not shown) for generating airflow, a battery, a removable dust bag 13 for accommodating dust and debris collected by the vacuum cleaner. The housing 12 also comprises a housing exhaust air outlet 14*a* and a housing air inlet (arranged on an under side of the housing 12 and in fluid communication with the airflow in an interior of the elongated shaft part 11). Hence, the airflow enters the housing air inlet and exits the housing exhaust air outlet 14*a*, and dust and debris is deposited in the air-permeable dust bag 13.

In FIG. 1, the housing 12 is arranged on an upper side of the shaft part 11, i.e. the side facing away from the surface to be cleaned during use of the vacuum cleaner 10, but it may instead be arranged on the opposite side of the shaft part 11. Advantageously, this allows for better reach under objects such as sofas and beds.

Further, as will be discussed in the below, the housing 12 may be arranged to be moveably attached to the elongated shaft part 11, such that the housing 12 is moveable along at least a part of the length of the elongated shaft part 11, either in distinct steps or continuously adjustable along the length of the elongated shaft part 11, or arranged to be removably attachable to the elongated shaft part 11 at at least two different positions such that the user can remove the housing 12 from the shaft part 11 from one of the at least two positions and place the housing 12 in a second of the two different positions. For instance, the housing 12 and the elongated shaft part 11 may be arranged with a snap-in member for swiftly attaching and removing the housing 12 from the shaft part 11. Alternatively, the housing 12 is fixedly attached to the elongated shaft part 11 such that it cannot slide along the length of the shaft part.

A handle 15 may be arranged at an end of the shaft part 11 to be held by a user for moving the vacuum cleaner 10 over a surface to be cleaned. The handle 15 may optionally comprise a control arrangement 16, e.g. a push button or a slider, for control of at least one of a fan effect, a nozzle function or any other vacuum cleaner function which may need to be adjustable. Hence, the control arrangement 16 can be operated by a user to turn the vacuum cleaner 10 on and off.

A nozzle 17 is arranged at another end of the elongated shaft part 11, via which nozzle debris is transported from a surface to be cleaned by means of the airflow caused by the motor fan unit to the dust bag 13.

Hence, the nozzle 17 is arranged at a first end of the elongated shaft part 11 while the optional handle 15 is arranged at a second end of the elongated shaft part 11. In the following, the first end and the second end will be referred to as the "nozzle end" and the "handle end", respectively.

The nozzle 17 is further being pivotally coupled to the nozzle end of the elongated shaft part 11 such that the shaft part 11 can be more or less freely pivoted about the nozzle 17 while the underside of the nozzle 17 is flush against the surface to be cleaned for good cleaning performance.

Hence, the housing 12 comprises an air-permeable removable dust bag 13, an air inlet for dust laden air, and an air outlet 14*a* for exhaust air, and a motor fan unit generating an airflow. The air inlet is connected to an air channel in the elongated shaft part 11, which air channel is connected to the nozzle 17 in one end of the shaft part 11. The nozzle 17 has a nozzle inlet, and the motor fan unit generates an airflow for transporting debris from the nozzle inlet through the air channel into the housing 12 via the air inlet, through the dust bag 13 to the motor fan unit. After the airflow has passed the motor fan unit, the airflow exits the housing 12 via the exhaust air outlet 14*a*.

Figure 2A:
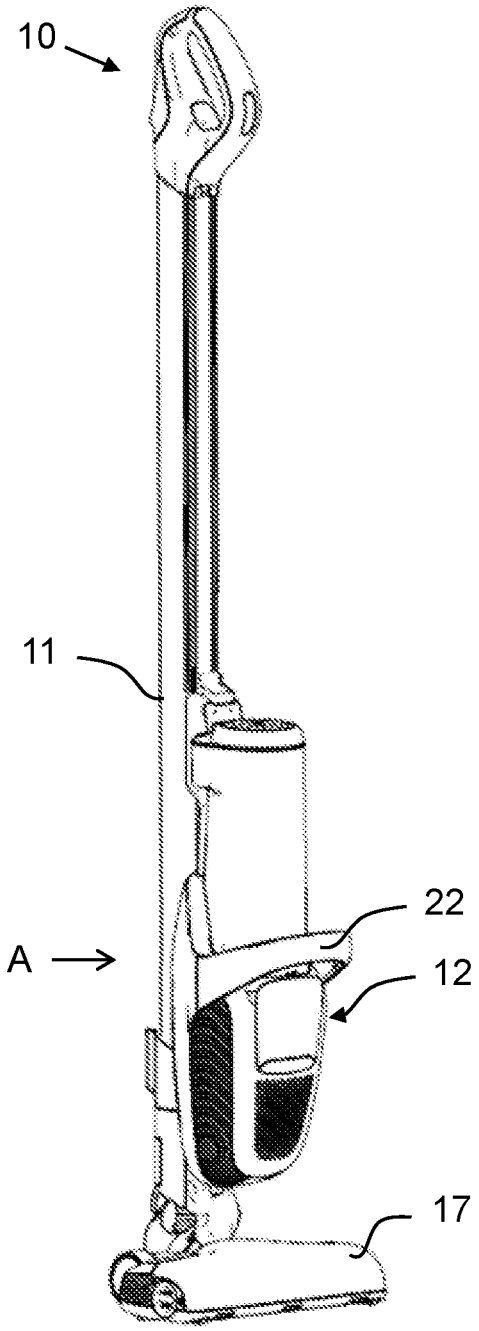
FIGS. 2*a* and 2*b* illustrate the vacuum cleaner of FIG. 1 in another view where a housing is moved along the length of a shaft part of the vacuum cleaner between a first position and a second position.
Figure 2B:
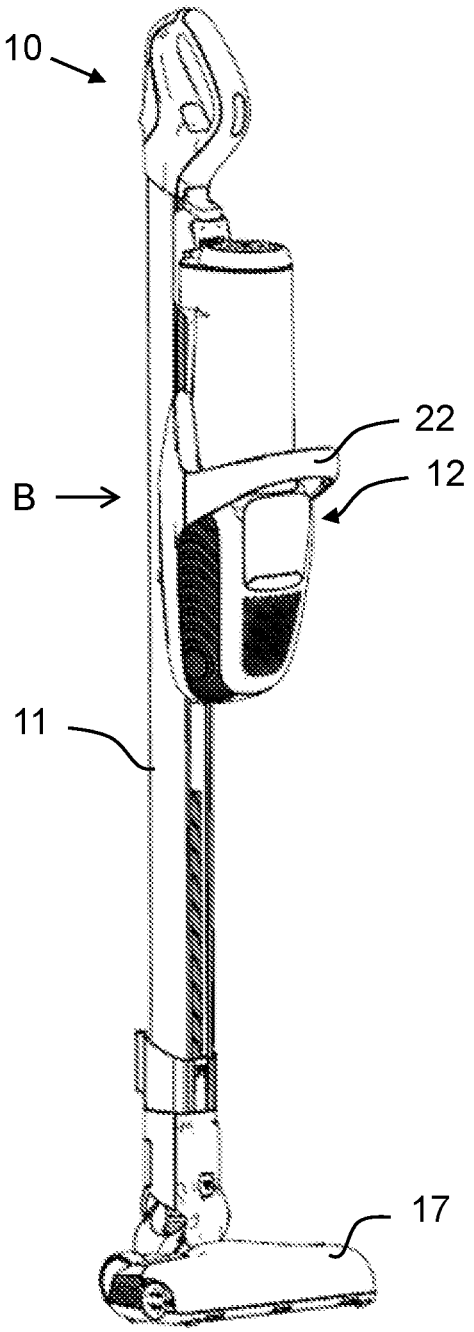

FIGS. 2*a* and 2*b* illustrate the vacuum cleaner 10 in another view where the housing 12 is moved along the length of the elongated shaft part 11 between a first position A and a second position B, either by sliding the housing 12 along the elongated shaft part 11, or by removing the housing 12 being attached at position A of the shaft part 11 and subsequently attaching the housing to the elongated shaft part 11 at position B. Alternatively, the housing is fixedly attached to (and thus cannot slide along) the elongated shaft part 11

Optionally, the housing may comprise a handle 22 that can be operated by a user to move the housing 12 along, or from, the elongated shaft part 11.

The housing 12 can typically be arranged in a number of different positions along the length of the elongated shaft part 11. The first position A and the second position B may serve as examples of housing positions. In some embodiments the housing 12 may be arranged in e.g. 2-6 distinct positions along the length of the elongated shaft part 11. In some embodiments the housing 12 may be arranged to be freely slidable and to be attachable at any position along the length of the elongated shaft part 11. The housing 12 may be fixed in a selected position by a latch of any kind and released when the latch is opened.

It should be understood that the present invention may be implemented in an upright vacuum cleaner having a fixedly arranged housing.

Figure 3A:
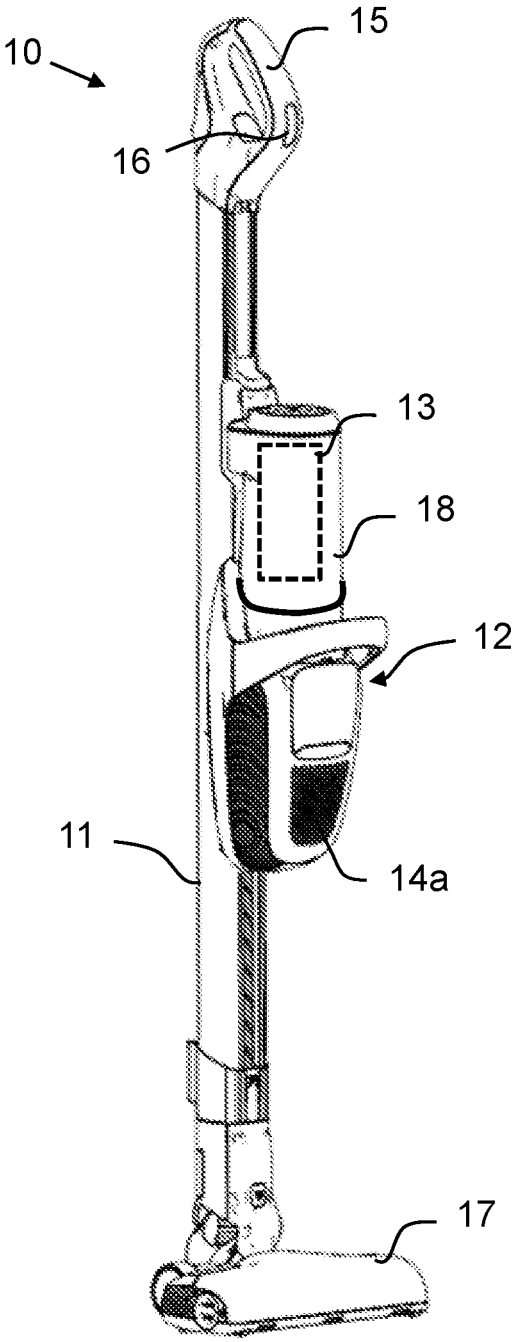
FIGS. 3*a* and 3*b* illustrate the vacuum cleaner of FIGS. 1, 2*a* and 2*b*, further comprising a removable dust container according to an embodiment.
Figure 3B:
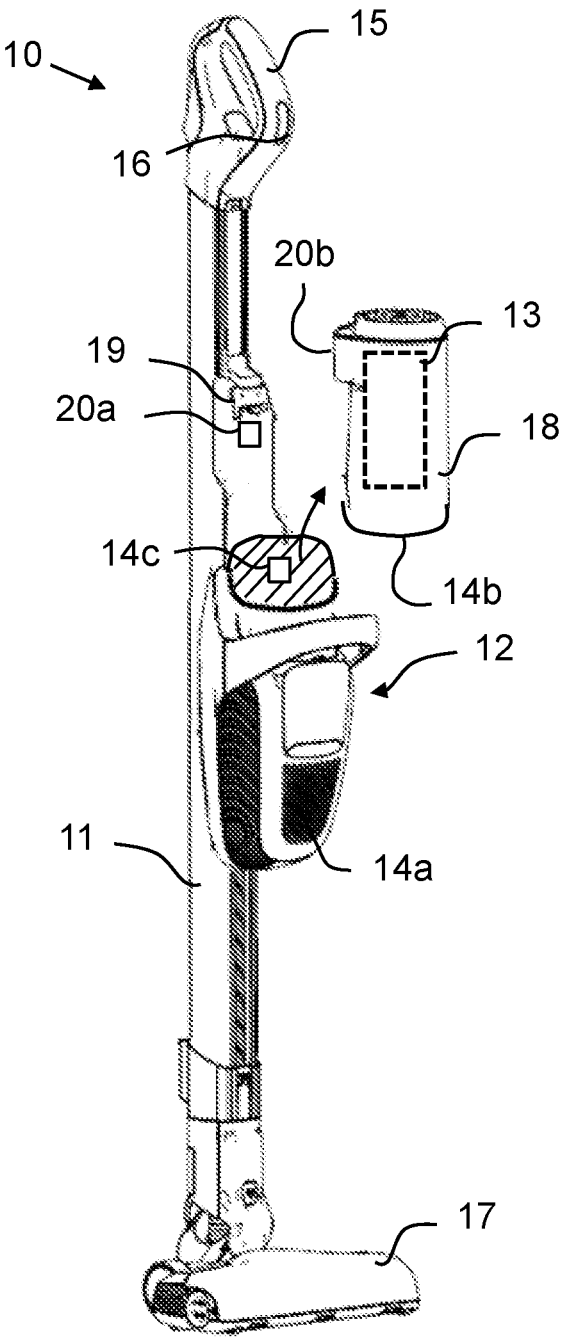

FIGS. 3*a* and 3*b* illustrates a vacuum cleaner 10 according to an embodiment of the invention.

As can be seen in FIGS. 3*a* and 3*b*, at least a part 18 of the housing 12 where the air-permeable dust bag 13 is arranged is configured to be removably attached to the housing 12, for instance by means of a snap-in mechanism 19 which easily can be pressed by the user to remove the part 18 as illustrated in FIG. 3*b*. In the following, the removable part 18 is referred to as a container or dust container, i.e. a container arranged to accommodate the removable dust bag 13.

In FIG. 3*b*, the snap-in mechanism 19 is arranged at a top section of the dust container 18 where a shaft air outlet 20*a* is arranged to mate with the housing air inlet 20*b* of the container 18, but could alternatively be arranged at a bottom section of the dust container 18, i.e. the section facing the nozzle end of the vacuum cleaner 10.

Further, at the bottom section of the dust container 18, a container air outlet 14*b* is arranged to mate with a motor fan inlet 14*c* being in fluid communication with the motor fan unit and the air outlet 14*a* of the housing 12.

Now, as is understood, the dust container 18 typically only constitutes a sub-part of the complete housing 12. As previously discussed, the housing 12 further comprises a motor fan unit, a battery, etc., and these components are not to be removed with the dust container 18.

Advantageously, the user can easily and straightforwardly remove the removable dust container 18 from the housing 12 and simply carry the removable dust container 18 to a garbage can for disposing the dust bag 13, and thereafter again attach the removable dust container 18 to the housing 12, after or before a new dust bag 13 has been placed in the container 18.

In an embodiment, the container 18 is arranged with airtight walls. In a further embodiment, at least some part of the airtight container walls constitute the vacuum cleaner housing 12, and preferably a substantial part of the container walls are part of the vacuum cleaner housing 12.

Figure 4:
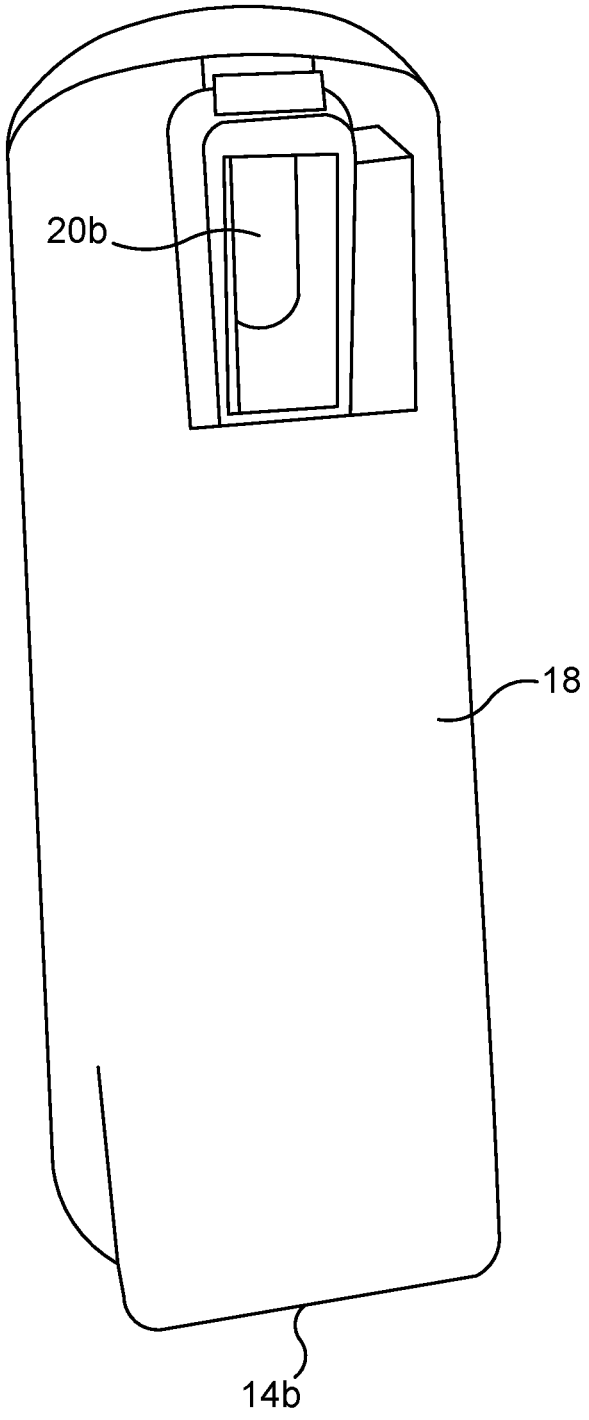
FIG. 4 illustrates a removable dust container according to an embodiment.

FIG. 4 shows a perspective view of the removable dust container 18 according to an embodiment. As can be seen, the container air outlet 14*b* which mates with the motor fan inlet 14*c* of the housing 12 is arranged in the bottom section of the dust container 18, while the housing air inlet 20*b* of the dust container 18 which mates with the shaft air outlet 20*a* of the housing 12 is arranged in a top section of the dust container 13.

Figure 5:
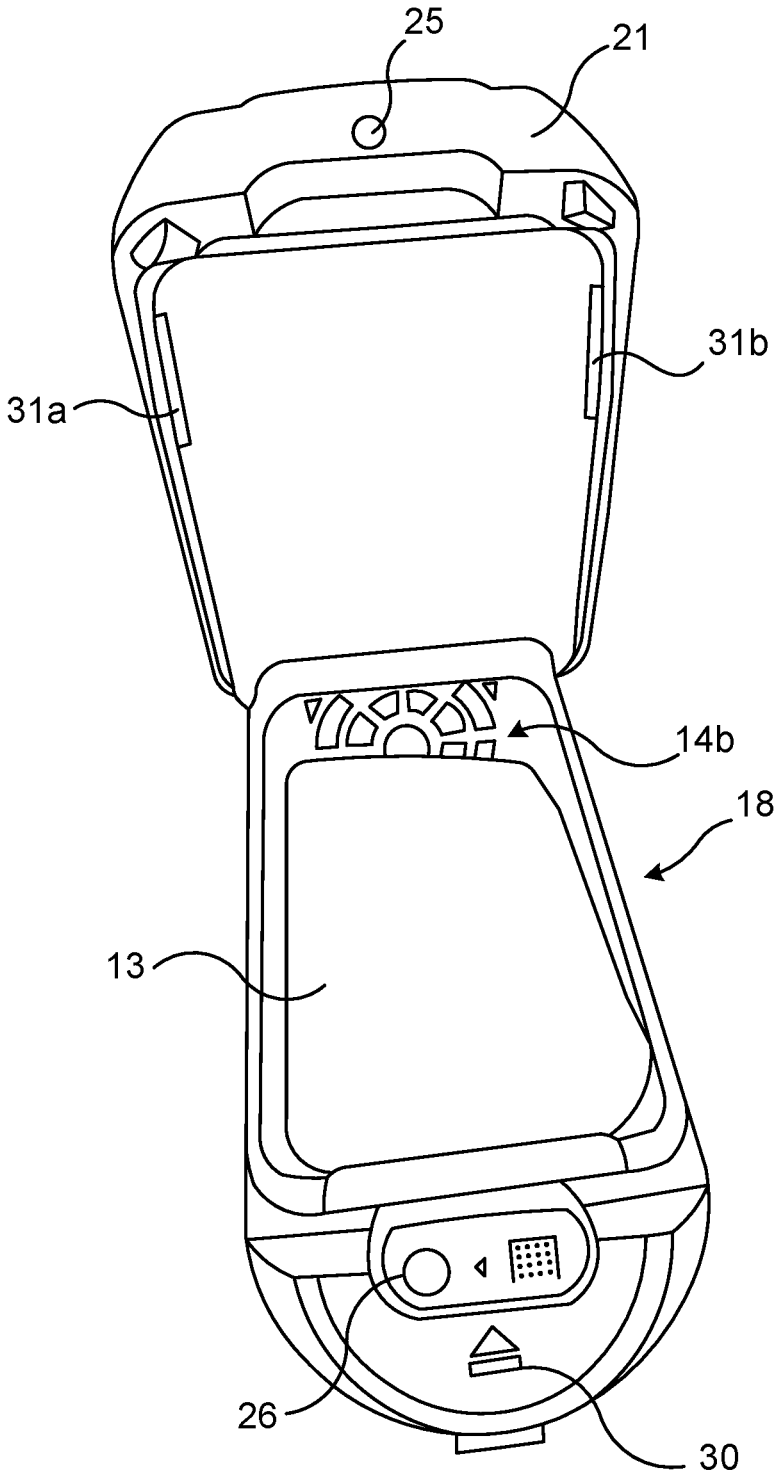
FIG. 5 illustrates a removable dust container according to further embodiments.

FIG. 5 shows a perspective view of the removable dust container 18 according to another embodiment seen from the top section of the container 18. The dust container 18 comprises an aperture 21 arranged to be openable for facilitating removal and emptying of the dust bag 13 which collects the dust and debris of the air flow entering the container 18 via the housing air inlet 20*b* before the (cleaned) air flow is exhausted via the container air outlet 14*b*.

In a further embodiment illustrated in FIG. 5, the removable dust container 18 comprises a push-button 25 being arranged to snap open the aperture 21 upon a user pressing the button for swift removal of the dust bag 13.

In yet a further embodiment illustrated in FIG. 5, the removable dust container 18 comprises a visual indicator 26 configured to indicate to a user a degree of fullness of the dust bag 13.

In a further embodiment, the container 18 further comprises a push-button 30 being arranged to release the container 18 from the housing 12 upon a user pressing the button 30.

In an embodiment, the aperture 21 further comprises at least one flange 31*a*, 31*b* arranged to press against the dust bag 13 upon a user closing the aperture 21. Advantageously, this will facilitate the bag 13 being correctly positioned in the container 18 when the aperture 21 is closed.

Figure 6:
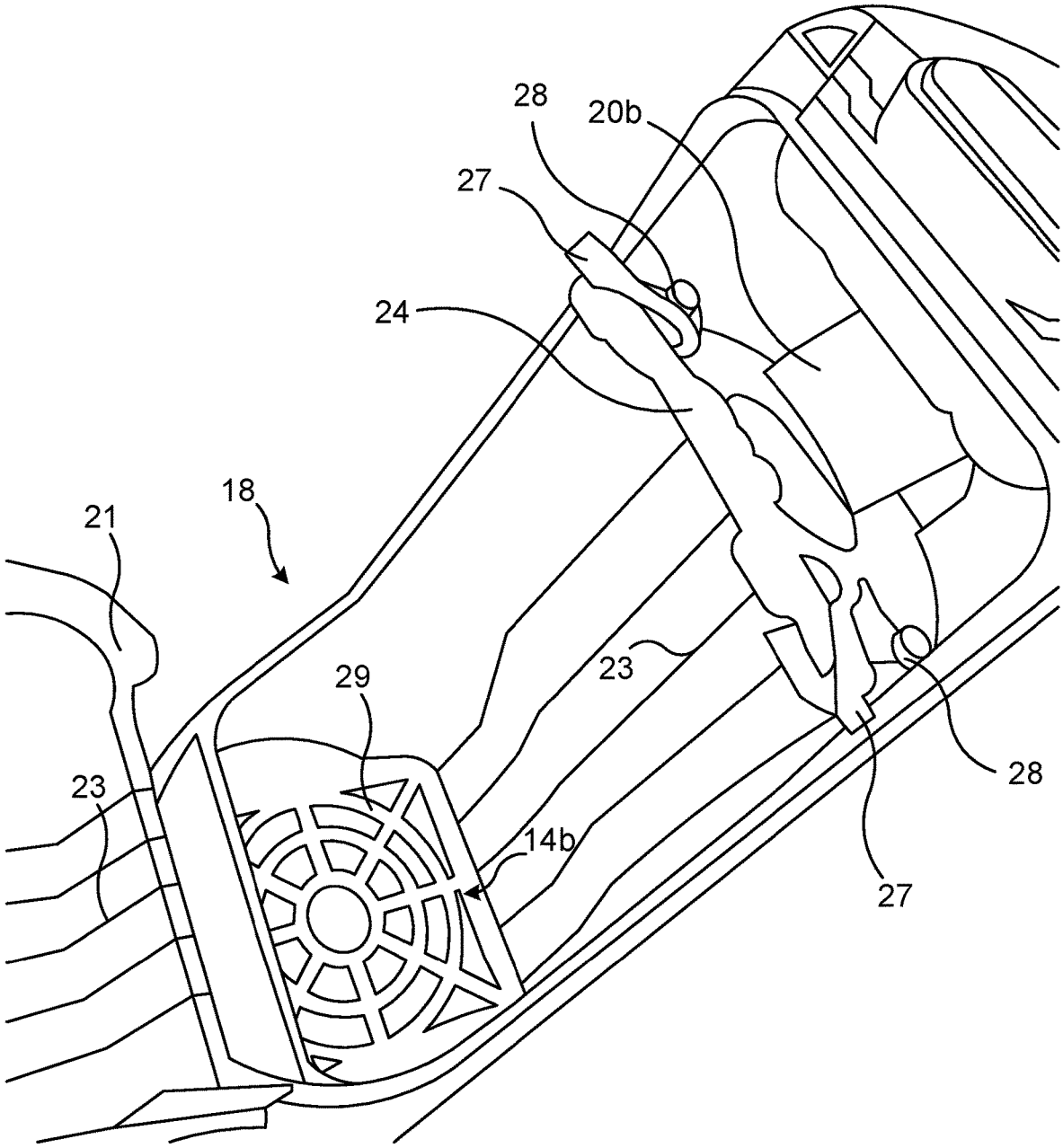
FIG. 6 illustrates a removable dust container according to embodiments.

FIG. 6 shows a perspective view of the removable dust container 18 according to another embodiment where aperture 21 of the dust container is opened showing the previously discussed housing air inlet 20*b* and container air outlet 14*b*.

In this embodiment, the dust container 18 is further arranged with elongated protruding members, in this view along a longitudinal axis of the container 18, on its interior walls in order to advantageously prevent a dust bag (not shown in FIG. 6) from adhering to the interior walls of the dust container 18, thereby blocking the air flow passing from the housing air inlet 20*b* to the container air outlet 14*b*.

Further, the container air outlet 14*b* may be arranged with one or more protruding members 29 for advantageously preventing a dust bag from adhering to the air outlet 14*b* of the dust container 18, thereby blocking the air flow passing from the housing air inlet 20*b* to the container air outlet 14*b*.

Further shown in FIG. 6 is a bracket 24 arranged to accommodate a removable dust bag. In FIG. 6, the bracket 24 is arranged in the top section of the container 18.

In an embodiment, the container 18 comprises a blocking device 27 being arranged to prevent the aperture 21 from being closed when no dust bag is accommodated in the bracket 24.

In an embodiment, the bracket 24 is arranged with at least one spring-loaded member 27 configured to block the aperture 21 such that the aperture cannot be closed when no dust bag is placed in the bracket 24.

When placing a dust bag in the bracket 24, the dust bag will press against the spring-loaded member 27, causing the spring 28 to compress and move the spring-loaded member 27 in a transversal direction towards an interior of the dust container 18, thereby allowing the aperture 21 to be closed.

When removing the dust bag from the bracket, no force is exerted onto the spring-loaded member 27, causing the spring 28 to expand and move the spring-loaded member 27 in a transversal direction towards an exterior of the dust container 18, thereby acting as a bar and blocking the aperture 21 such that it cannot be closed. Advantageously, this prevents a user from operating the vacuum cleaner 10 if no dust bag is placed in the bracket 24.

Figure 7:
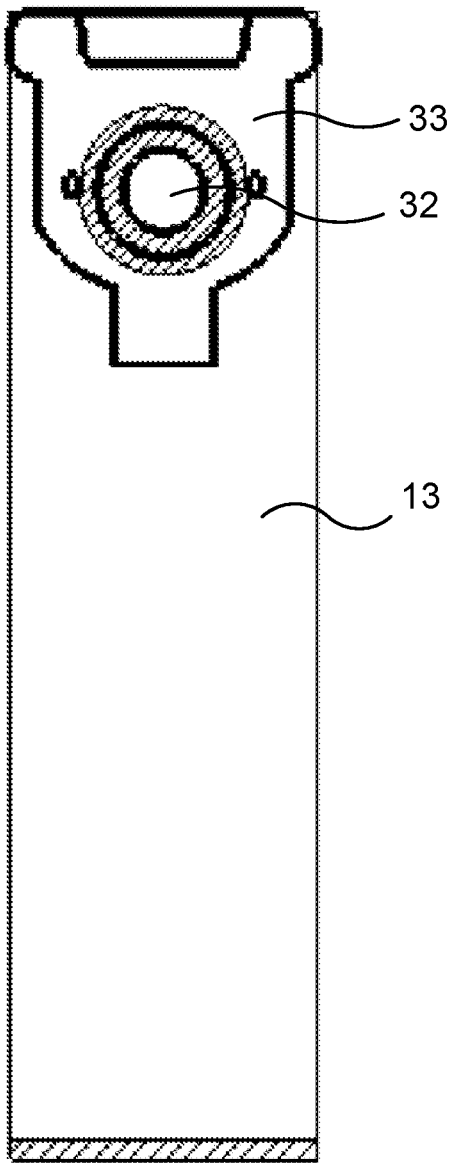
FIG. 7 illustrates an example of a dust bag to be utilized in the vacuum cleaner according to an embodiment.
Figure 8:
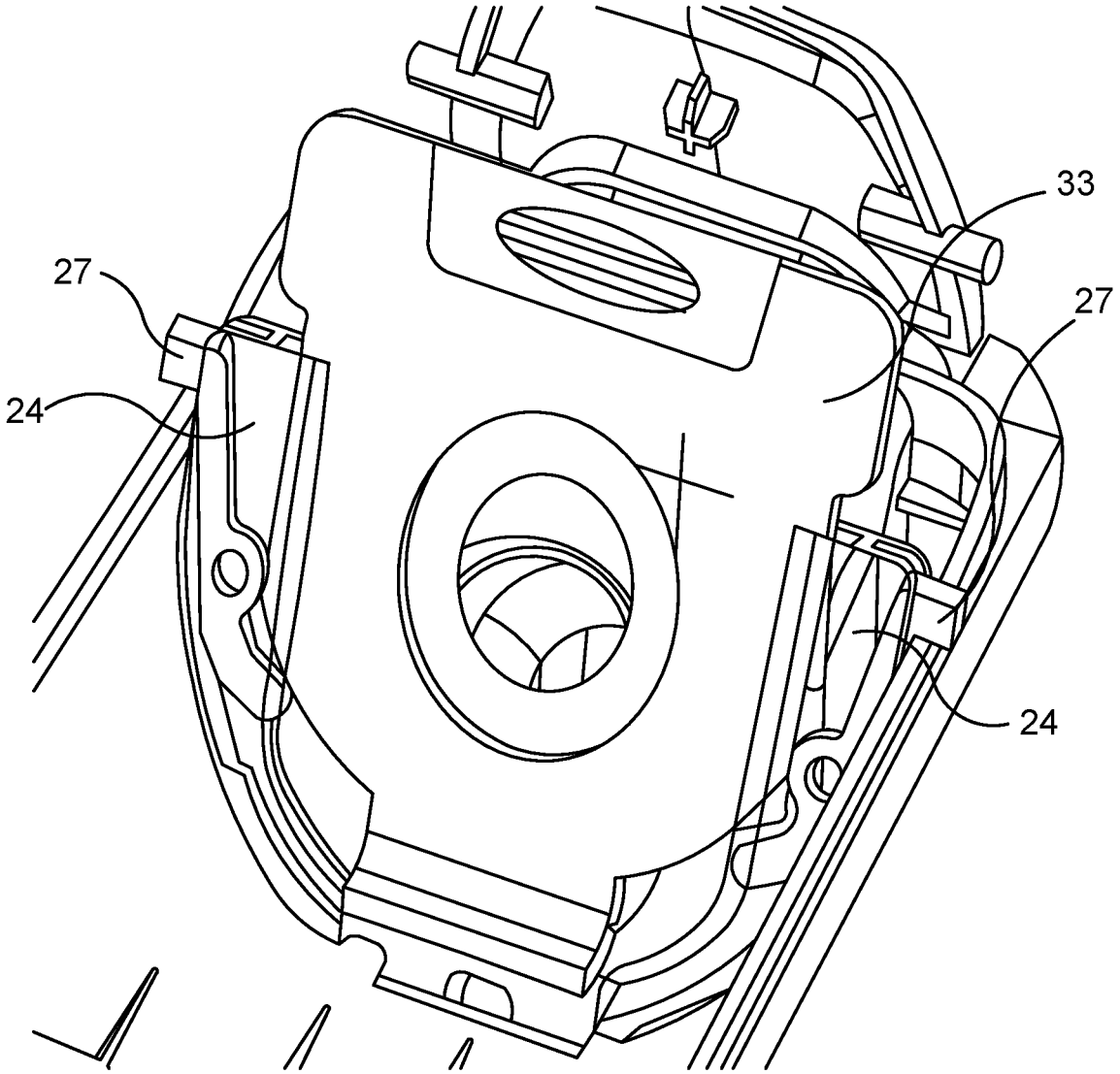
FIG. 8 illustrates a bracket arranged to hold the dust bag according to an embodiment.

FIG. 7 shows an example of a dust bag 13 which can be used with the stick vacuum cleaner according to the invention, while FIG. 8 shows the bracket 24 for holding the dust bag 13 in the container 18 in an embodiment.

The dust bag 13 is made of an air permeable material and comprises a connector plate 33. The connector plate 33 further has a hole 32 which surrounds an opening in the bag, such that the connector plate 33 can correctly position the opening within a vacuum 15*i* cleaner by the connector plate 33 being inserted in the bracket 24 of the vacuum cleaner.

Hence, the connector plate 33 of the dust bag 13 is inserted into, and thus engages with, the bracket 24 which holds the dust bag 13 in operating position in the container 18.

As further can be seen in FIG. 8, since no dust bag 13 is placed in the bracket 24, the spring-loaded members 27 advantageously block the aperture 21 from being closed.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A stick vacuum cleaner comprising:

an elongated shaft part;

a housing configured to be attached to the elongated shaft part, the housing comprising an air inlet, a container configured to accommodate a removable air-permeable dust bag, a motor fan unit configured to create an airflow, and an exhaust air outlet;

a nozzle arranged at a first end of the elongated shaft part, the nozzle comprising a nozzle inlet configured to transport debris from a surface to be cleaned to a dust container by means of the created airflow; and a handle arranged at a second end of the elongated shaft part; wherein:

the container is configured to be removably attached to the housing and comprises an aperture configured to be openable for facilitating removal of the removable air-permeable dust bag, and a bracket configured to accommodate the removable air-permeable dust bag and including at least one spring-loaded member configured to block the aperture from being closed when no removable air-permeable dust bag is placed in the bracket, wherein the removable air-permeable dust bag is configured to press against the spring-loaded member when placed in the bracket, causing a spring of the spring-loaded member to compress and move the spring-loaded member in a transversal direction towards an interior of the container, thereby allowing the aperture to be closed, and wherein removal of the removable air-permeable dust bag causes the spring to expand and move the spring-loaded member in a transversal direction towards an exterior of the container, thereby blocking the aperture from being closed.

2. The stick vacuum cleaner of claim 1, wherein the aperture further comprises at least one flange configured to press against the removable air-permeable dust bag upon a user closing the aperture.

3. The stick vacuum cleaner of claim 1, wherein the container further comprises a push-button configured to snap open the aperture upon a user pressing the push-button.

4. The stick vacuum cleaner of claim 1, wherein the container further comprises a container air outlet arranged in a bottom section of the container and configured to mate with a motor fan inlet that is in fluid communication with the exhaust air outlet.

5. The stick vacuum cleaner of claim 1, wherein the air inlet is arranged in a top section of the container and configured to mate with a shaft air outlet arranged on the elongated shaft part and in fluid communication with the nozzle.

6. The stick vacuum cleaner of claim 1, wherein the container further comprises a snap-in mechanism configured to removably attach the container to the housing.

7. The stick vacuum cleaner of claim 1, wherein the container further comprises elongated protruding members arranged on an interior wall of the container.

8. The stick vacuum cleaner of claim 4, wherein the container further comprises one or more protruding members arranged at the air outlet of the container.

9. The stick vacuum cleaner of claim 1, wherein the dust container further comprises a visual indicator configured to indicate to a user a degree of fullness of the removable air-permeable dust bag.

10. The stick vacuum cleaner of claim 1, wherein the container further comprises a push-button configured to release the container from the housing upon a user pressing the push-button.

11. The stick vacuum cleaner of claim 1, wherein the container comprises airtight walls.

12. The stick vacuum cleaner of claim 11, wherein at least some part of the airtight walls constitute the vacuum cleaner housing.

13. The stick vacuum cleaner of claim 1, wherein the removable air-permeable dust bag a connector plate configured to engage with the bracket.

14. The stick vacuum cleaner of claim 11, wherein a majority of the airtight walls constitute the vacuum cleaner housing.

15. The stick vacuum cleaner of claim 7, wherein the elongate protruding members are arranged along a longitudinal axis of the container.

16. The stick vacuum of claim 1, wherein the housing is attachable and detachable to the elongated shaft part at a first position on the elongated shaft part and a second position along the elongated shaft part.

17. The stick vacuum of claim 1, wherein the housing is slidable along the elongated shaft part between a first position on the elongated shaft part and a second position along the elongated shaft part.

18. The stick vacuum of claim 1, wherein the housing is slidable along and attachable to the elongated shaft part at any position along the length of the elongated shaft part.

19. The stick vacuum of claim 18, wherein the housing comprises a latch configured to fix the housing in a selected position along the length of the elongated shaft part and release the housing to slide along the elongated shaft part when the latch is opened.

20. The stick vacuum of claim 1, wherein the housing comprises a handle that can be operated by a user to move the housing along or from the elongated shaft part.

* * * * *